United States Patent [19]

Struve et al.

[11] 4,280,799

[45] Jul. 28, 1981

[54] COMPRESSOR WITH GUIDE BAFFLES AND GAS-PERMEABLE MATERIAL SEPARATING MEANS

[75] Inventors: Hans-Dirk Struve, Bühlertal; Jürgen Hess; Theodor Vysiotis, both of Baden-Baden, all of Fed. Rep. of Germany

[73] Assignee: Robert Bosch GmbH, Stuttgart, Fed. Rep. of Germany

[21] Appl. No.: 19,089

[22] Filed: Mar. 9, 1979

[30] Foreign Application Priority Data

Apr. 10, 1978 [DE] Fed. Rep. of Germany ..... 2815471

[51] Int. Cl.[3] ..... F04C 29/02; B01D 50/00; B01D 45/06

[52] U.S. Cl. ..... 418/97; 418/DIG. 1; 55/320; 55/419; 55/434; 55/465; 55/DIG. 25

[58] Field of Search ..... 418/97–100, 418/93, DIG. 1; 55/320, 419, 434, 465, DIG. 25; 62/470, 473

[56] References Cited

U.S. PATENT DOCUMENTS

| | | | |
|---|---|---|---|
| 2,272,926 | 2/1942 | Squiller | 55/320 |
| 2,496,676 | 2/1950 | Rawson | 418/97 |
| 2,846,138 | 8/1958 | Racklyeft | 55/DIG. 25 |
| 2,875,592 | 3/1959 | Olsen | 62/470 |
| 3,040,974 | 6/1962 | Langdon | 418/93 |
| 3,385,513 | 5/1968 | Kilgore | 418/98 |
| 3,850,009 | 11/1974 | Villadsen | 62/470 |
| 3,989,490 | 11/1976 | Adalbert et al. | 418/99 |

*Primary Examiner*—John J. Vrablik
*Attorney, Agent, or Firm*—Michael J. Striker

[57] ABSTRACT

A housing surrounds a compressor for cooling media and forms at one axial end of the same a chamber which receives from the compressor one or more streams of gaseous cooling medium in which compressor lubricating oil is entrained. The chamber communicates with an outlet of the housing and is filled with a body of gas-permeable material through which the stream or streams must pass on the way to the outlet, and which separates entrained oil from the gaseous cooling medium.

10 Claims, 2 Drawing Figures

COMPRESSOR WITH GUIDE BAFFLES AND GAS-PERMEABLE MATERIAL SEPARATING MEANS

BACKGROUND OF THE INVENTION

The present invention relates to a compressor.

More particularly, the invention relates to a compressor which is especially—though not exclusively—suitable for use with refrigerant media.

In refrigeration and air-conditioning systems compressors are used to compress vaporized cooling medium so that it will subsequently condense in the condenser of the cooling system.

Compressors must be lubricated, which is done with oil. Since the compressed vapor (gas) passing through the compressor has a tendency to mingle with and entrain the oil in form of a fine mist, it is necessary to remove the oil from the gas stream before the same passes beyond the compressor. For this purpose it has been proposed to have the compressor outlet valves communicate with a small oil separator composed of a casing which is constituted from a multi-layer wire mesh packing and with end plates through an axial inlet opening of one of which the gas-oil mixture enters. The gas leaves through the mesh material and the oil is retained by the same.

The problem with this prior-art proposal is that the oil-removal efficiency of the construction is at best mediocre, so that undesirable quantities of oil are able to enter the cooling system with the gas exiting from the compressor.

SUMMARY OF THE INVENTION

It is an object of the invention to avoid the shortcomings of the prior art.

A more particular object is to provide an improved compressor which offers a much higher efficiency of oil separation from the gas stream than those known heretofore.

An additional object is to provide such an improved compressor in which use is made of the force of gravity to enhance the effectiveness of oil and gas separation.

Still a further object is to provide an improved compressor in which oil is efficiently separated from the gas stream while subjecting the gas stream to minimum flow resistance.

In keeping with these objects, and still others which will become apparent hereafter, one aspect of the invention resides in a compressor, particularly for cooling media, having an outlet for a stream of compressed gaseous fluid in which lubricating oil of the compressor is entrained, a combination comprising a housing forming a chamber which communicates with the outlet of the compressor to receive the stream of gaseous fluid and oil therefrom, the chamber having a discharge opening; a body of gas-permeable material filling the chamber so that the stream must pass through the body on its way to the discharge opening, with concomitant separation of the entrained oil from the gaseous fluid; and wall means in part bounding an oil sump space in a bottom part of the housing beneath the body, so that separated oil drips from the body into the oil sump space.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
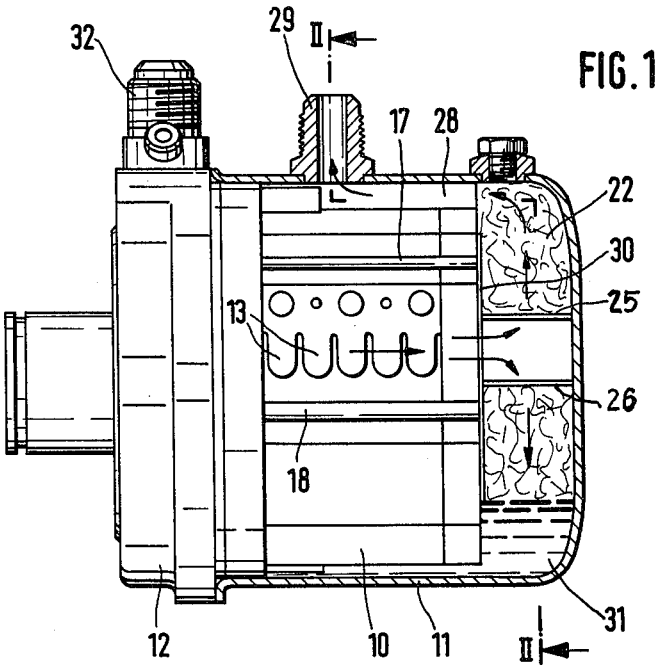
FIG. 1 is an axial section through a device embodying the invention, with parts omitted for the sake of clarity.
Figure 2:
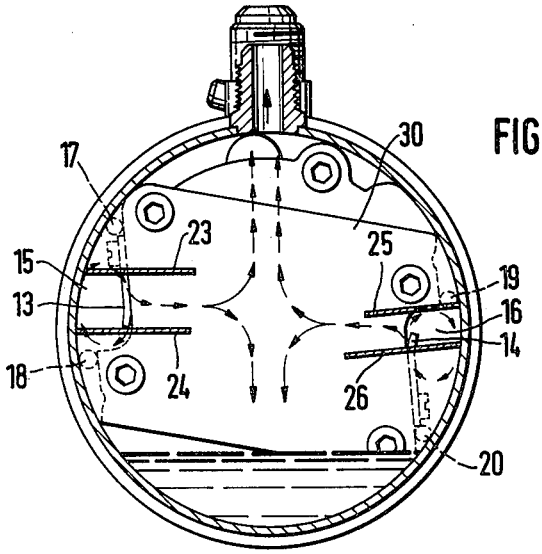
FIG. 2 is a section taken on line II—II of FIG. 1.

In FIGS. 1 and 2 the actual compressor 10 is illustrated only diagrammatically. This is done because the compressor per se is known in the art (any of the known cooling-medium compressors may be used) and in order to improve the clarity of illustration of those aspects which relate to the actual invention.

With this in mind it will be seen that the compressor 10 is accommodated in a housing 11 (of e.g. sheet metal) having an open end which is closed by a cover 12. The cover 12, on which the compressor 10 is mounted, has an inlet nipple 32 through which the vaporized cooling medium enters the compressor, as indicated by the arrow.

The compressor is of the double-stream type and has tongue-shaped outlet valves 13, 14 (one set for each gas stream) which communicate with respective compartments 15, 16. The compartments are defined between the wall of compressor 10 and the wall of housing 11 (see FIG. 2) and are sealed by sealing strips 17, 18, 19, 20 (extending longitudinally of housing 11) to prevent gas losses.

The inner end of the compressor 10 (the one remote from cover 12) is spaced from the closed end of housing 11, so that an elongated chamber 22 is left free in the housing (FIG.) 1. This chamber 22 has an axial length equal to about one-third of the length of compressor 10; it is the oil separation chamber and is filled with a gas permeable material, e.g. wire mesh, steel wool, open-celled synthetic plastic material such as polyurethane, or a loose filling of appropriate discrete particles (for example pellets of synthetic plastic of polyurethane or the like). What is important is that the material in chamber 22 have a high surface-to-volume ratio, so as to offer as little flow resistance as possible to the gas stream. Also, the material must not be subject to either physical or chemical attack or change by the gas-oil mixture under the operating conditions (e.g. pressure and temperature) of the device. The aforementioned materials meet these requirements.

The compartments 15, 16 extend along the outside of the compressor 10 (i.e. from its left end to its right end in FIG. 1) and are open to the chamber 22 at the compressor outlet. Mounted in the chamber 22 at opposite sides of the chamber inlet opening which communicates with the compressor outlet and has a center axis extending lengthwise of the chamber elongation are pairs of parallel baffles 23, 24 and 25, 26. These extend over the entire axial length of chamber 22 and project radially inwardly from the wall of housing 11 but terminate well short of the center of chamber 22. They are also so located that the space between the baffles of each pair communicates with, and constitutes an extension of, the respective compartments 15 and 16.

Above the compressor 10, defined between the same and the housing 11, is a space 28 which communicates with the chamber 22 and also with an outlet nipple 29 that is secured to the housing 11 (preferably closer to the end thereof having the cover 12 than to the other end). Nipple 29 is adapted to communicate with a user, i.e. the next element in a system of which the disclosed device is to constitute a part. Below the compressor 10, defined between the same and the housing 11, is an oil sump 31. That part of housing 11 which accommodates the compressor 10, is separated from the chamber 22 by an endplate 30 (of e.g. sheet metal) except for the communication between the chamber 22 and the spaces 28 and 31 and for the open ends of compartments 15 and 16.

The cover 12 is provided with the previously mentioned inlet nipple 32 which communicates with the intake (not shown) of the compressor 10, and through which the compressor aspirates the gaseous medium. During the compression of this medium in the compressor 10 it becomes mixed with the oil serving to lubricate the compressor and the resulting stream of gas mixed with oil leaves the compressor via the outlet valves 13, 14 to enter the compartments 15, 16. In these compartments the mixture flows toward the chamber 22 and enters the gas-permeable material therein after flowing along the baffles 23, 24 and 25, 26. On passing through the gas-permeable material in chamber 22, on its way to the space 28 and the outlet nipple 29, the fine oil droplets entrained by the gas become deposited on the gas-permeable material and the thus deposited droplets agglomerate to form larger drops of oil which eventually run off the material in chamber 22 and drip into the sump 31. The formation of increasingly larger oil drops is enhanced by the fact that the gas-oil stream undergoes a progressive decrease in flow speed due to the increase in the flow cross-section in direction towards the space 28.

As shown by the arrows in FIG. 2, the gas-oil mixture entering the compartments 15, 16 via the valves 13, 14 undergoes a rotary movement about the longitudinal axis of the respective compartment as its travels along the same to the space between the respective pairs of baffles 23, 24 and 25, 26. Each gas-oil stream then escapes from between the respective pair of baffles and travels towards the center of chamber 22. At or near the center the two gas-oil streams then collide and are deflected as shown by the arrows. The oil droplets drip into the sump 31 and the cleaned gas rises through chamber 22 and passes via space 28 into the outlet nipple 29.

It is noted that the arrangement and use of the guide baffles 23–26, coupled with the illustrated position of the space 28 relative to the chamber 22, affords a flow direction which is highly advantageous, since the gas-oil mixture must travel over a comparatively long distance before entering the space 28 (so that maximum time is available for separation of the oil from the gas) and the separated oil cannot become re-entrained in the cleaned gas (since the separated oil drips down into sump 31 under the influence of gravity and thus moves away from the gas).

It has been found that it is particularly advisable for the chamber 22 to have a volume which is equal to between 1.5 and 3 times the displacement volume of the compressor 10, since this relationship facilitates the desired reduction of flow speed in the chamber 22. The guide baffles, the gas-permeable material in chamber 22, and the arrangement of the various spaces relative to one another causes the gas-oil mixture to undergo a great number of changes in its flow direction before the exit of chamber 22 is reached. This results in good utilization of the density differences between the gas and the oil, for the purpose of facilitating their separation. The separation is further enhanced by the infringement of the two gas-oil streams upon one another at or near the center of chamber 22. The relatively large volume of chamber 22, coupled with the ready gas permeability of the material therein, assures that the gas flow is throttled only slightly, so that there are no undesirably high losses of kinetic energy.

It will be understood that the invention is susceptible of a variety of modifications. For example, the compressor could be of the single-flow type, i.e. of the type from which only a single flow of gas-oil mixture issues. If so, one of the compartments 15, 16 and its associated pair of baffles would then of course be omitted.

While the invention has been illustrated and described as embodied in a compressor for cooling media, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. In a compressor particularly for cooling media, having outlet means for streams of compressed gaseous fluid in which lubricating oil of the compressor is entrained, a combination comprising a housing forming an elongated chamber which is located immediately adjacent to and communicates with the outlet means of the compressor to receive the streams of gaseous fluid and oil therefrom, said chamber including an inlet opening having a center axis extending lengthwise of the elongation of said chamber and communicating with said outlet means; a body of gas-permeable material filling said chamber so that the streams must pass through said body on their way to a discharge opening, with concomitant separation of the entrained oil from the gaseous fluid; wall means in part bounding an oil sump space in a bottom part of said housing beneath said body, so that separated oil drips from said body into said oil sump space; and a plurality of guide baffles on said housing and projecting adjacent said outlet means in direction radially inwardly of said chamber towards but short of the center of the chamber, said guide baffles comprising at least two pairs of baffles located at opposite sides of said inlet opening, and the two baffles of each pair extending lengthwise of the direction of elongation of said chamber and being spaced from but substantially parallel to each other.

2. In a compressor, particularly for cooling media, having outlet means for streams of compressed gaseous fluid in which lubricating oil of the compressor is entrained, a combination comprising a housing forming an elongated chamber which is located immediately adjacent to and communicates with the outlet means of the compressor to receive the streams of gaseous fluid and oil therefrom, said chamber having an inlet opening communicating with said outlet means; a body of gas-permeable material filling said chamber so that the streams must pass through said body on their way to a discharge opening, with concomitant separation of the entrained oil from the gaseous fluid; wall means in part bounding an oil sump space in a bottom part of said housing beneath said body, so that separated oil drips from said body into said oil sump space; and a plurality of guide baffles on said housing and projecting adjacent said outlet means in direction radially inwardly of said chamber towards but short of the center of the chamber, said guide baffles comprising at least two pairs of baffles located at opposite sides of said inlet opening, and the two baffles of each pair extending lengthwise of the direction of elongation of said chamber and being spaced from but substantially parallel to each other.

3. A combination as defined in claim 2, the guide baffles comprising means in said chamber for directing the streams towards one another for mutual impingement in the vicinity of the center of said chamber and for abrupt changing of the flow direction of said streams.

4. A combination as defined in claim 3, said housing further forming an outlet space of unobstructed cross-section and connecting said chamber with said discharge opening of said chamber.

5. A combination as defined in claim 2 wherein said guide baffles are located at a level higher than the upper anticipated level of oil in said sump space.

6. A combination defined in claim 2, said body being a wire mesh material.

7. A combination as defined in claim 2, said body being steel wool.

8. A combination as defined in claim 2, said body being an open-cell synthetic plastic foam material.

9. A combination as defined in claim 2, said body being composed of a plurality of discrete pourable particles.

10. A combination as defined in claim 2, the compressor having a casing received in said housing and having portions extending close to said housing and other portions spaced from said housing to define compartments with said housing which extend from the outlet means of the compressor to said chamber; and further comprising sealing strips extending along said compartments and sealing the same against escape of gas and oil.

* * * * *